US006553197B1

(12) United States Patent
Leenhouts et al.

(10) Patent No.: US 6,553,197 B1
(45) Date of Patent: Apr. 22, 2003

(54) NOISE-FREE SILENCER ASSEMBLY

(75) Inventors: Timothy J. Leenhouts, Fairport, NY (US); Warren F. Brydges, Walworth, NY (US); George A. Schutt, Pittsford, NY (US); Richard J. Manzolati, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 5 days.

(21) Appl. No.: 10/071,296

(22) Filed: Feb. 11, 2002

(51) Int. Cl.[7] ..... G03G 15/00

(52) U.S. Cl. ..... 399/159; 399/91; 399/159; 399/350

(58) Field of Search ..... 399/91, 159, 350

(56) References Cited

U.S. PATENT DOCUMENTS

| | | | | |
|---|---|---|---|---|
| 5,722,016 A | | 2/1998 | Godlove et al. | 399/159 |
| 5,960,236 A | * | 9/1999 | Zaman et al. | 399/91 |
| 5,991,573 A | * | 11/1999 | Nohsho et al. | 399/159 |
| 6,438,338 B1 | * | 8/2002 | Mark et al. | 399/91 |

FOREIGN PATENT DOCUMENTS

| | | |
|---|---|---|
| JP | 63060481 | 3/1988 |
| JP | 63271388 | 11/1988 |
| JP | 2118684 | 5/1990 |

* cited by examiner

*Primary Examiner*—Quana M. Grainger
(74) *Attorney, Agent, or Firm*—Talum I. Nguti

(57) ABSTRACT

A noise-free silencer assembly is provided that is suitable for reducing self-vibration noises and screeching noises between a cleaning blade and the imaging member of an electrostatographic reproduction machine. The noise-free silencer assembly comprises a C-shaped cross-section elongate member having (a) a longitudinal axis, a wall defining an interior cavity for containing at least a partially compressed high density polymeric open cell foam, (b) a slot formed in the wall extending generally longitudinally and at an angle to the longitudinal axis of the C-shaped cross-section member, and (c) a hinge recess also formed in the wall extending generally longitudinally, for reducing self-vibration noises and screeching noises between a cleaning blade and an imaging member of an electrostatographic reproduction machine.

20 Claims, 3 Drawing Sheets

NOISE-FREE SILENCER ASSEMBLY

BACKGROUND OF THE INVENTION

This invention relates in general to electrostatographic reproduction machines, and more particularly to a noise-free silencer assembly for reducing self-vibration noises, and screeching noises between a cleaning blade and the imaging member of an electrostatographic reproduction machine.

Electrostatographic imaging members are well known in the art. The imaging members may be in the form of various configurations such as a flexible web type belt or cylindrical drum. The drums comprise a hollow cylindrical substrate and at least one electrostatographic coating. These drums are usually supported by a hub held in place at the end of each drum. The hub usually includes a flange that extends into the interior of the drum and usually retained in place by an adhesive. An axle shaft through a hole in the center of each hub supports the hub and drum assembly.

Electrostatographic imaging members as such may be electrostatographic or electrographic members. It is well known that electrostatographic members comprise at least one photosensitive imaging layer and are imaged with the aid of activating radiation in image configuration whereas electrographic imaging members comprise at least one dielectric layer upon which an electrostatic latent image is formed directly on the imaging surface by shaped electrodes, ion streams, styli and the like. A typical electrostatographic imaging process cycle involves forming an electrostatic latent image on the imaging surface, developing the electrostatic latent image to form a toner image, transferring the toner image to a receiving member and cleaning the imaging surface. Cleaning of the imaging surface of electrostatographic imaging members is often accomplished with a doctor type resilient cleaning blade that is rubbed against the imaging surface of the imaging members.

When electrostatographic imaging members are cleaned by doctor type cleaning blades rubbing against the imaging surface to remove residual toner particles remaining on the imaging surface after toner image transfer to a receiving member, a high pitched ringing, squealing, squeaking, or howling sound can be created which is so intense that it is intolerable for machine operators. This is especially noted in drum type imaging members comprising a hollow cylindrical substrate. The sound apparently is caused by a "stick-slip" cycling phenomenon during which the cleaning blade initially "sticks" to the imaging surface and is carried in a downstream direction by the moving imaging surface to a point where resilience of the imaging blade forces the tucked blade to slip and slide back upstream where it again sticks to the photoreceptor and is carried downstream with the imaging surface until blade resilience again causes the blade to flip back to its original position.

The upstream flipping motion kicks residual toner particles forward. The stick-slip phenomenon is somewhat analogous to the use of a push broom for cleaning floors where the push broom is most effective for cleaning when it is pushed a short distance and then tapped on the floor with the cycle being repeated again and again. This stick-slip phenomenon is important for effective removal of residual untransferred toner particles from an imaging surface and for prevention of undesirable toner film or toner comets from forming on the imaging surface during cleaning.

An adhesive relationship between the cleaning blade and the imaging member surface appears to contribute to the creation of the ringing, squealing, squeaking, or howling sound. More specifically, the stick-slip effect occurs where there is a strong adhesive interaction between the cleaning blade and the imaging surface. The ringing, squealing, squeaking, or howling sound appears to be caused by resonant vibration of the drum induced by the stick-slip phenomenon. Other factors contributing to creation of the ringing, squealing, squeaking, or howling sound may include factors such as the construction of the imaging member, the blade contacting the imaging member, the type of blade holder construction, and the like. For example, a flimsy blade holder can contribute to the howling effect. Moreover, a thinner, shorter, stubbier cleaning blade tends to contribute the howling effect. Thin imaging member drums can also lead to the howling effect.

The stick-slip phenomenon also depends on the lubricating effect of toner and/or carrier materials utilized. Moreover, ambient temperatures can contribute to the creation of howling. It appears that resonance is initiated at the point of contact between the cleaning blade and the imaging member. The creation of the squealing or howling sound might be analogous to rubbing a fingertip around the edge of a wine glass. The squealing or howling noise phenomenon is especially noticeable for cylindrical photoreceptors having a hollow metal or plastic drum shaped substrate. Generally, where the imaging member is the cause of a howling sound, it will emit a ringing sound when tapped.

These sounds cannot be tolerated in a office environment. To overcome this drawback, various devices have been developed which can be inserted inside the hollow drum to dampen the drum and diminish or eliminate all irritating sounds emitted during imaging operation. Some of these devices include, for example, porous members which are compressed when inserted inside a hollow photoreceptor drum to perform a sound deadening function while pressing against the inner surface of the drum. Examples of this type of sound dampener is described, in U.S. Pat. No. 5,722,016, Japanese Patent Publication 63060481, published Mar. 16, 1998 and Japanese Patent Publication 63271388, published Nov. 9, 1998.

Another such device for preventing undesirable sounds in a drum photoreceptor includes a control member having a "C" cross-section. This type of device is described, for example, in Japanese Patent Publication 02118684, published May 2, 1990. This device is difficult to compress and slide into a hollow drum unless the control member is very thin. A very thin control member may not have sufficient mass to dampen any squeaking sound. However, thicker silencer members having a "C" shaped cross-section may be utilized if modified to form a hinge of thinner material extending axially along the length of the "C" shaped member. The hinge of thinner material is preferably located opposite the gap of the "C" shaped member. This hinge allows a relatively thick silencer to be more easily squeezed so that the exposed ends at the longitudinal gap come together to form a silencer having a smaller cross-section thereby allowing the silencer to be inserted into the hollow drum. This arrangement also facilitates removal of the silencer from the drum for recycling.

Conventionally, the "C" shaped cross-section silencers each consist of a tube having a straight external hinge feature and an opposing slot that are both cut into the tube and aligned parallel to the tube axis. Unfortunately, it has been found that the parallel alignment of the hinge feature and slot in these silencers undesirable contribute to self-vibration noises or vibrational chattering noises coming from the silencer tubes themselves.

It has been found that there is a significant risk having two or more conventional silencers aligned within the photoreceptor drum of a machine, in such way that their parallel slots and hinge recesses are lined up with the axis of the drum and with each other. In such a case, such an alignment is likely to cause photoreceptor drum distortion because there is a significant radial outward force exerted by the silencers against the thin wall of the photoreceptor drum.

Thus, there is a need for a noise-free silencer assembly that reduces self-vibration noises, and screeching noises between a cleaning blade and the imaging member of an electrostatographic reproduction machine.

SUMMARY OF THE INVENTION

In accordance with the present invention, there is provided a noise-free silencer assembly for reducing self-vibration noises, and screeching noises between a cleaning blade and the imaging member of an electrostatographic reproduction machine. The noise-free silencer assembly comprises a C-shaped cross-section elongate member having (a) a longitudinal axis, a wall defining an interior cavity for containing at least a partially compressed high density polymeric open cell foam, (b) a slot formed in the wall extending generally longitudinally and at an angle to the longitudinal axis of the C-shaped cross-section member, and (c) a hinge recess also formed in the wall extending generally longitudinally, for reducing self-vibration noises and screeching noises between a cleaning blade and an imaging member of an electrostatographic reproduction machine.

In accordance with the present invention, there is provided a noise-free silencer assembly for reducing self-vibration noises, and screeching noises between a cleaning blade and the imaging member of an electrostatographic reproduction machine. The noise-free silencer assembly includes (i) at least a partially compressed high density polymeric open cell foam inserted into a portion of an interior cavity of a C-shaped cross-section member, and (ii) a C-shaped cross-section member having longitudinal axis, a wall defining an interior cavity for containing the at least a partially compressed high density polymeric open cell foam, and a slot formed in the wall extending generally longitudinally and at an angle to the longitudinal axis of the C-shaped cross-section member for reducing self-vibration noises and screeching noises between a cleaning blade and the imaging member of an electrostatographic reproduction machine.

BRIEF DESCRIPTION OF THE DRAWINGS

In general, the advantages of the improved drum supporting hub and drum assembly will become apparent upon consideration of the following disclosure of the invention, particularly when taken in conjunction with the accompanying drawings wherein.

These figures merely schematically illustrate the invention and are not intended to indicate relative size and dimensions of actual devices and components thereof.

DETAILED DESCRIPTION OF THE DRAWINGS

The present invention may be employed in any suitable electrostatographic imaging member comprising a cylindrical drum substrate and at least one electrostatographic imaging layer that generates high pitched ringing, squealing, squeaking, or howling sounds when utilized with a cleaning device such as a cleaning blade or any other proximal device which causes vibrations, especially in the audible range, to be generated in the aforementioned electrostatographic imaging member. However, for purposes of illustration, the invention will be described with reference to an electrostatographic imaging drum.

Figure 1:
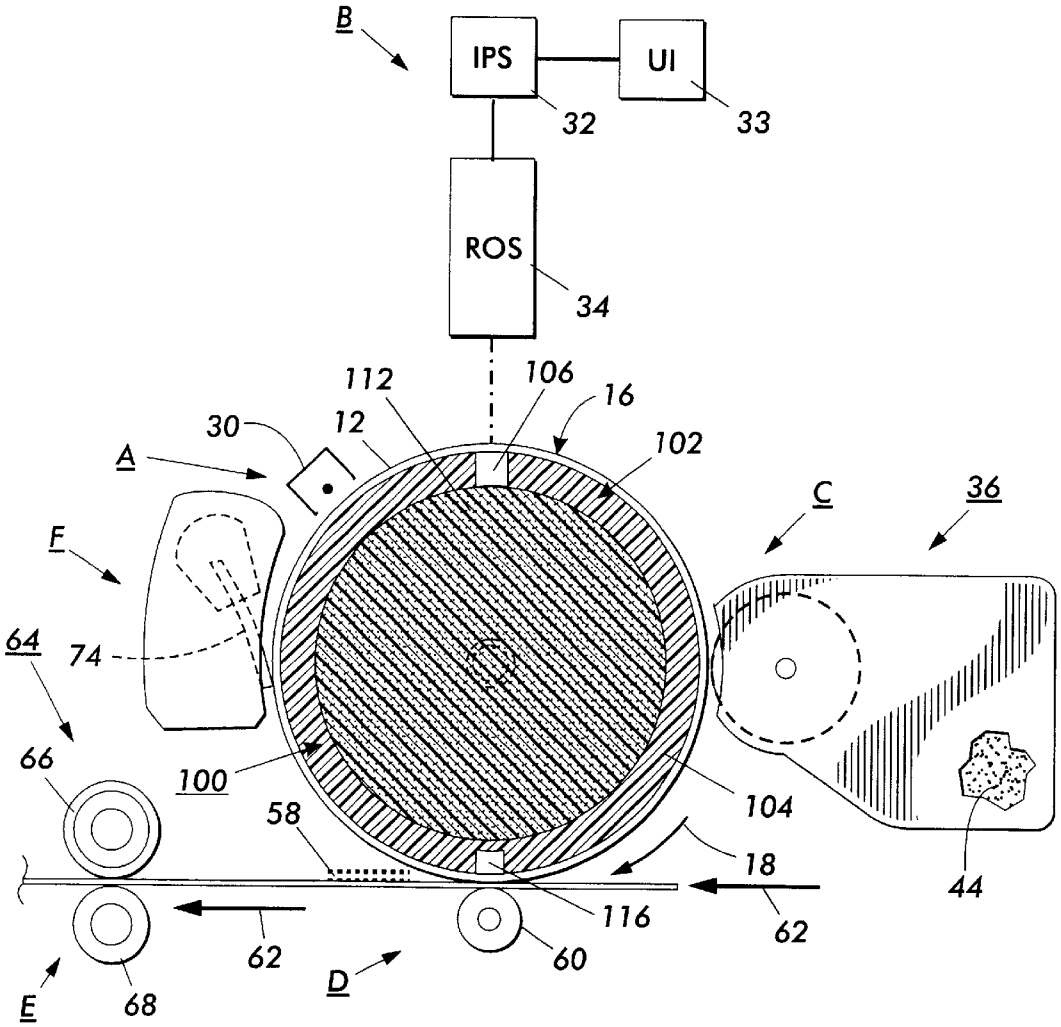
FIG. 1 is a schematic elevational view of an illustrative electrostatographic reproduction machine incorporating the noise-free silencer assembly of the present invention.

Referring now to FIG. 1, the electrostatographic reproduction machine 8 of the present invention is shown, and shown employs a photoconductive drum 16, although photoreceptors in the form of a belt are also known, and may be substituted therefor. The drum 16 has a photoconductive surface deposited on a conductive substrate. Drum 16 moves in the direction of arrow 18 to advance successive portions thereof sequentially through the various processing stations disposed about the path of movement thereof.

Initially successive portions of drum 16 pass through charging station AA. At charging station AA, a corona generating device, indicated generally by the reference numeral 30, charges the drum 16 to a selectively high uniform electrical potential. The electrical potential is normally opposite in sign to the charge of the toner. Depending on the toner chemical composition, the potential may be positive or negative. Any suitable control, well known in the art, may be employed for controlling the corona generating device 30.

Next, the charged portion of photoconductive surface 12 is advanced through exposure station BB. At exposure station BB, information that is indicative of the pages to be printed is transmitted to an image processing system (IPS), indicated generally by the reference numeral 31. IPS 32 is the control electronics which prepare and manage the image data flow to raster output scanner (ROS), indicated generally by the reference numeral 34. A user interface (UI), indicated generally by the reference numeral 33, is in communication with the IPS. The UI enables the operator to control the various operator adjustable functions. The output signal from the UI is transmitted to IPS 32. The signal corresponding to the desired image is transmitted from IPS 32 to ROS 34, which creates the output copy image. ROS 34 lays out the image in a series of horizontal scan lines with each line having a specified number of pixels per inch. The ROS includes a laser having a rotating polygon mirror block associated therewith. The ROS exposes the charged photoconductive surface of the printer.

At development station CC, a development system or unit, indicated generally by the reference numeral 36 advances developer materials into contact with the electrostatic latent images. The developer unit includes a device to advance developer material into contact with the latent image. The developer unit 36 develops the charged image areas of the photoconductive surface. This developer unit contains, for example, black developer material 44 having a triboelectric charge such that the black toner is attracted to charged areas of the latent image on surface 12.

A sheet of support material 58 is moved by means (not shown) into contact with the toner image at transfer station DD. As shown, transfer station DD includes a corona generating device 60 which sprays ions of a suitable polarity onto the backside of sheet 58. This attracts the toner powder image from the drum 16 to sheet 58. After transfer, the sheet continues to move, in the direction of arrow 62 to fusing station EE.

Fusing station EE includes a fuser assembly, indicated generally by the reference numeral 64, which permanently affixes the transferred powder image to sheet 58. Preferably, fuser assembly 64 comprises a heated fuser roller 66 and a pressure roller 68. Sheet 58 passes between fuser roller 66 and pressure roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator. It will also be understood that other post-fusing operations can be included, for example, binding, inverting and returning the sheet for duplexing and the like.

After the sheet of support material is separated from the photoconductive surface of drum 16, the residual toner particles carried by image and the non-image areas on the photoconductive surface are removed at cleaning station FF. The cleaning station FF includes a blade 74.

Figure 2:
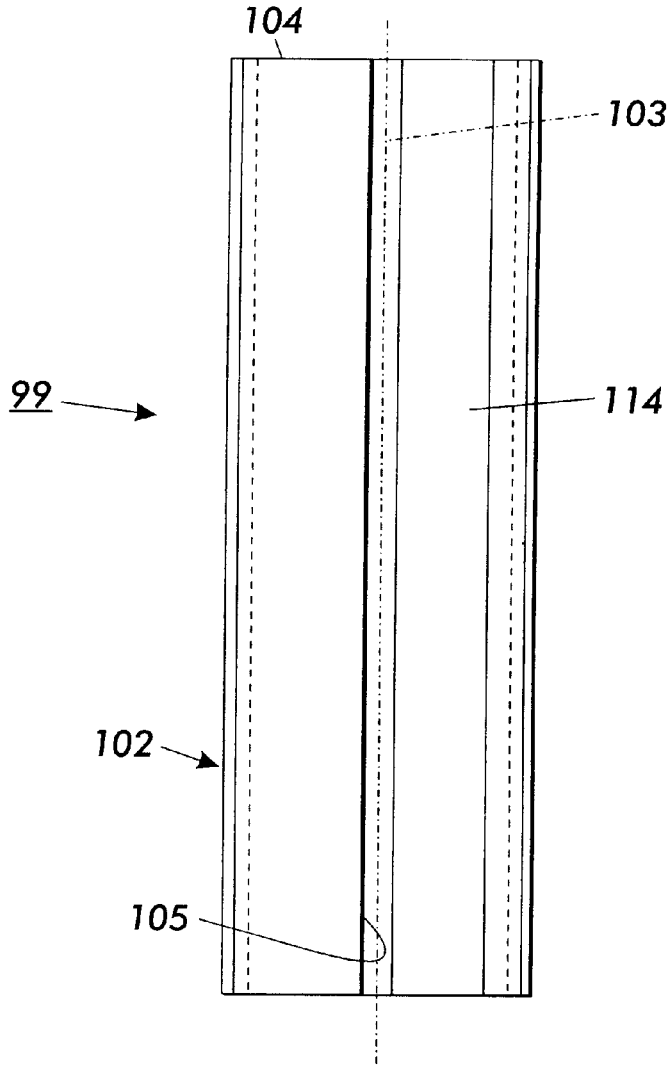
FIG. 2 (PRIOR ART)
FIG. 2 is illustrates a side view of a prior art silencer assembly.
Figure 3:
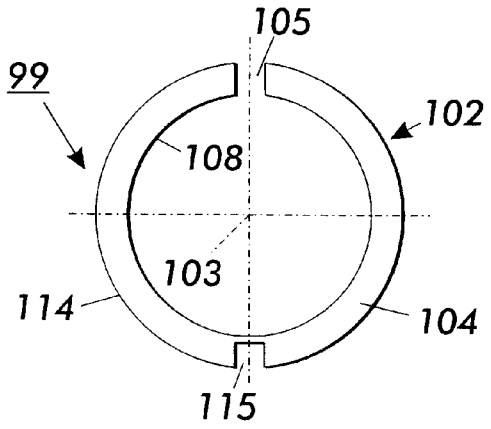
FIG. 3 (PRIOR ART)
FIG. 3 illustrates n end view of the prior art silencer assembly of FIG. 2.
Figure 4:
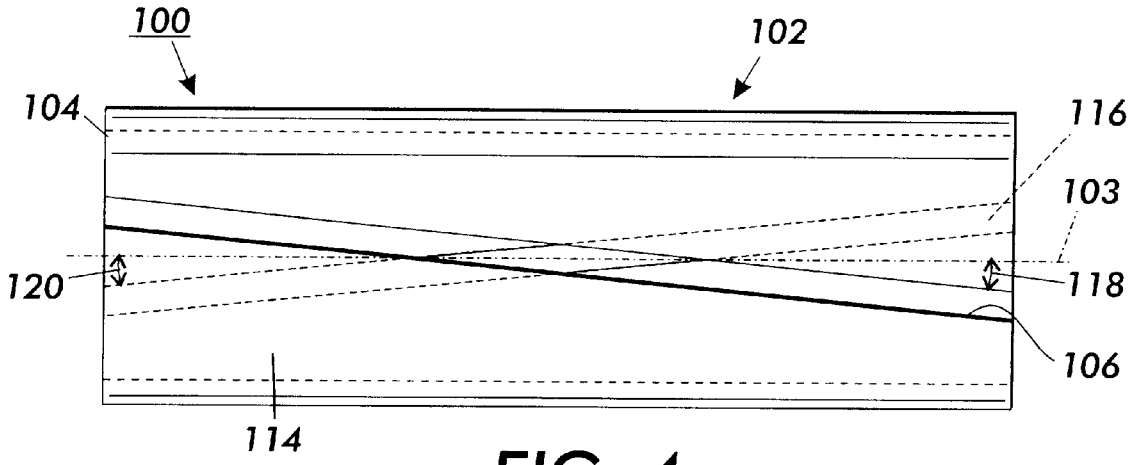
FIG. 4 illustrates a side view of a first embodiment of the noise-free silencer assembly of the present invention.
Figure 5:
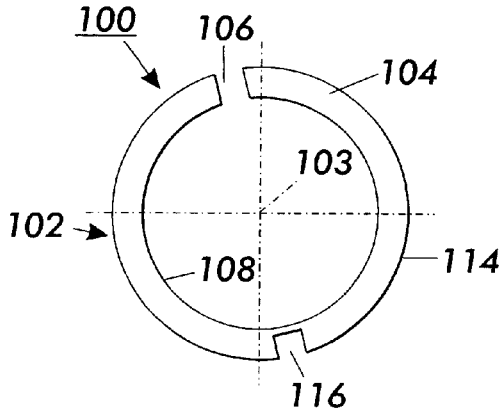
FIG. 5 illustrates an view of the first embodiment of the noise-free silencer assembly of the present invention.
Figure 6:
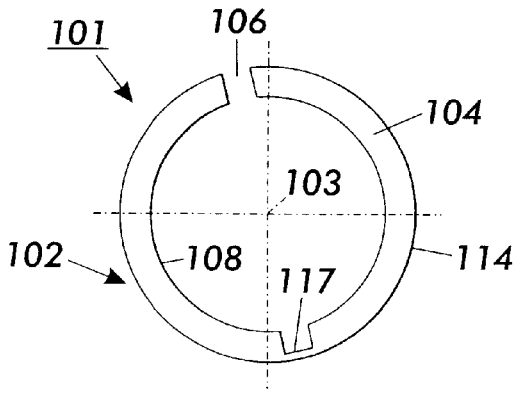
FIG. 6 illustrates an end view of a second embodiment of the noise-free silencer assembly of the present invention.

Referring to FIGS. 1 and 4–6, in order to prevent self-vibration noises, and the generation of high pitched ringing, squealing, squeaking, or howling sounds when the blade 74 is used as above to clean the surface 12 of electrostatographic imaging member or drum 16, the machine 8 includes the noise-free silencer assembly 100 of the present invention. A background or conventional silencer assembly 99, that suffers from the disadvantages addressed by the present invention, is illustrated in FIGS. 2 and 3, and disclosed for example in commonly assigned U.S. Ser. No. 09/143,049, currently issued as U.S. Pat. No. 5,960,236 on Sep. 28, 1999, and of which teaching portions thereof are incorporated herein by reference.

As shown in FIGS. 2 and 3, the conventional silencer assembly 99 includes a C-shaped cross-section member 102 having a slot 105 that is formed in through the wall 104 of the C-shaped cross-section member 102. As shown, the slot 105 as formed extends longitudinally and parallel to the longitudinal axis 103 of the C-shaped cross-section member 102. The conventional silencer assembly 99 includes a hinge recess 115 that is also formed in the wall 104, and that also extends generally longitudinally and parallel with the slot 105. As pointed out above, it has been found that the parallel alignment of the hinge recess 115 and slot 105 undesirably contribute to self-vibration noises or vibrational chattering noises from the conventional silencer assembly 99 itself.

Accordingly, as shown in FIGS. 1 and 4–6, the noise-free silencer assembly 100 includes a C-shaped cross-section elongate member 102 having (a) a longitudinal axis 103, a wall 104 defining an interior cavity 110 for containing at least a partially compressed high density polymeric open cell foam plug 112 for reducing screeching noises between a cleaning blade and an imaging member of an electrostatographic reproduction machine. The C-shaped member can be made of any suitable polymer.

As further shown, the noise-free silencer assembly 100 also includes a slot 106 formed in the wall 104 extending generally longitudinally, and at a first angle 118 to the longitudinal axis 103 of the C-shaped cross-section member 102. The noise-free silencer assembly 100 further includes a hinge recess 116, 117 also formed in the wall 104, also extending generally longitudinally, and in a manner so as not to be parallel with the slot 106.

In accordance with such manner, the hinge recess 116, 117 may also be formed extending generally longitudinally, and at a second angle 120 to the longitudinal axis 103 of the C-shaped cross-section member 102. Accordingly, at least one and even both of the slot 106 and recess 116, 117 should be non-parallel with the longitudinal axis 103 of C-shaped cross-section member 102.

An inner surface 108 of the wall 104 defines an interior cavity 110 having a predetermined inside diameter in the free state, (ii) at least one partially compressed high density polymeric open cell foam plug 112 inserted into the interior cavity 110.

The partially compressed high density polymeric open cell foam plug 112 in the uncompressed state has a substantially circular cross section in at least one plane. The circular cross section as such has an outside diameter that is sufficient to increase or expand the inside diameter of the hollow tube or C-shaped cross-section member 102 to a diameter at least about 5 percent greater than the predetermined inside diameter of the hollow tube in the free state (i.e. unencumbered state with no plug in the interior of tube 102). Hollow tube 102 comprises the wall 104 having a substantially uniform thickness, a hard exterior surface 114 and an interior surface 108 defining the cavity 110. Hollow tube 102 may comprise any suitable material such as plastic, metal, composites and the like.

As further shown, the recess 116, 117 has a depth that is less than the thickness of the tube wall 104. As shown, in the first embodiment of the silencer assembly 100, the hinge recess 116 is formed from the exterior surface 114 into the wall 104, and in the second embodiment 101, the hinge recess 117 is formed from the interior surface 108 into the wall 104. In each embodiment, the member, or hollow tube 102 contains the slot 106 through wall 104, and which in accordance with the present invention extends longitudinally at a first angle 118 relative to longitudinal axis 103 of tube 102. Although the slot 106 is illustrated as a slot having straight edges, any other suitable shape for the edges may be utilized, such as a slot having a wavy, sawtooth or spiral pattern.

The plane of the circular cross section of the plug 112 is ideally, but not necessarily, perpendicular to the longitudinal axis of hollow tube 102 when plug 112 is installed within the interior cavity 110 of tube 102. Increasing the inside diameter of the hollow tube 102 to a diameter at least about 5 percent greater than the predetermined inside diameter of the hollow tube in the free state, in combination with partially compressed plug 112, ensures positive pressure contact between hard exterior surface 114 and the interior surface of the photoreceptor drum 16.

Thus in the first embodiment 100, the present invention incorporates the cut slot 106, cut at a first angle 118 in the c-shaped cross-section member 102, and an externally formed hinge recess 116, for reducing the problem of piece to piece alignment which causes self-vibration noises. Alternatively, the second embodiment 101, may incorporate the cut slot 106, cut at a first angle 118 in the c-shaped cross-section member 102, and an internally formed hinge recess 117, for similarly reducing the problem of piece to piece alignment which causes self-vibration noises.

Thus in accordance with the present invention, the resultant non-parallel, spiral nature of the silencer slots 106 and hinge recesses 116, 117, have been found to effectively prevent any such a distortion.

As can be seen, there has been provided a noise-free silencer assembly is provided that is suitable for reducing self-vibration noises and screeching noises between a cleaning blade and the imaging member of an electrostatographic reproduction machine. The noise-free silencer assembly comprises a C-shaped cross-section elongate member having (a) a longitudinal axis, a wall defining an interior cavity for containing at least a partially compressed high density polymeric open cell foam, (b) a slot formed in the wall extending generally longitudinally and at an angle to the longitudinal axis of the C-shaped cross-section member, and (c) a hinge recess also formed in the wall extending generally longitudinally, for reducing self-vibration noises and screeching noises between a cleaning blade and an imaging member of an electrostatographic reproduction machine.

While the invention has been described in detail with particular reference to preferred embodiments thereof, it will be understood that variations and modifications can be effected within the spirit and scope of the invention as described herein above and as defined in the appended claims.

What is claimed is:

1. A noise-free silencer assembly for reducing self-vibration noises, and screeching noises between a cleaning blade and the imaging member of an electrostatographic reproduction machine, the silencer assembly comprising:

(a) a C-shaped cross-section member having a longitudinal axis, and a wall defining an interior cavity for containing at least a partially compressed high density polymeric open cell foam;

(b) a slot formed in said wall extending generally longitudinally and at an angle to said longitudinal axis of said C-shaped cross-section member; and (c) a hinge recess also formed in said wall extending generally longitudinally, for reducing self-vibration noises and screeching noises between a cleaning blade and an imaging member of an electrostatographic reproduction machine.

2. The noise-free silencer assembly of claim 1, wherein said hinge recess extends generally longitudinally and at an angle to said longitudinal axis of said C-shaped cross-section member.

3. The noise-free silencer assembly of claim 1, wherein said slot and said hinge recess each extend generally longitudinally and at an angle to said longitudinal axis of said C-shaped cross-section member.

4. The noise-free silencer assembly of claim 1, wherein said C-shaped member comprises a non-metallic tube.

5. The noise-free silencer assembly of claim 1, wherein said C-shaped member is made of any suitable polymer.

6. The noise-free silencer assembly of claim 1, wherein said C-shaped member includes a wall having at least one recess extending axially thereof and having a depth that is less than a thickness of said wall.

7. A noise-free silencer assembly for reducing self-vibration noises, and screeching noises between a cleaning blade and an imaging member of an electrostatographic reproduction machine, the noise-free silencer assembly comprising:

(i) at least a partially compressed high density polymeric open cell foam for insertion into a portion of an interior cavity of a C-shaped cross-section member; and (ii) a C-shaped cross-section member having longitudinal axis, a wall defining an interior cavity for containing said at least a partially compressed high density polymeric open cell foam, and a slot formed in said wall extending generally longitudinally and at an angle to said longitudinal axis of said C-shaped cross-section member, for reducing self-vibration noises and screeching noises between a cleaning blade and an imaging member of an electrostatographic reproduction machine.

8. The noise-free silencer assembly of claim 7, wherein said C-shaped member comprises a non-metallic tube.

9. The noise-free silencer assembly of claim 7, wherein said C-shaped member is made of any suitable polymer.

10. The noise-free silencer assembly of claim 7, wherein said first C-shaped member includes a wall having a hinge recess extending axially thereof and having a depth that is less than a thickness of said wall.

11. A noise-free silencer assembly comprising:

(a) a first hollow tube member including a wall having a thickness, an exterior surface and an interior surface defining an interior cavity having a predetermined inside diameter, said first wall having a hinge recess extending generally longitudinally and at an angle to said longitudinal axis of said C-shaped cross-section member; and (b) a slot formed in said wall extending generally longitudinally for preventing alignment between said recess and said slot, thereby preventing self-vibration noises in said silencer assembly.

12. The noise-free silencer assembly of claim 11, including at least one partially compressed preformed high density polymeric open cell foam plug within said interior cavity of said hollow tube member.

13. The noise-free silencer assembly of claim 12, wherein said polymeric open cell foam plug in an uncompressed state has a substantially circular cross section.

14. An electrostatographic reproduction machine comprising:

(a) a moveable imaging member having an exterior image bearing surface;

(b) imaging devices for forming a toner image on said image bearing surface;

(c) a transfer assembly for transferring the toner image unto a copy sheet;

(d) a cleaning blade assembly for cleaning said image bearing surface in preparation for the forming of another toner image; and (e) a noise-free silencer assembly for reducing self-vibration noises, and screeching noises between said cleaning blade assembly and said image bearing surface of said imaging member, the noise-free silencer assembly including:

(i) a C-shaped cross-section member having a longitudinal axis, and a wall defining an interior cavity for containing at least a partially compressed high density polymeric open cell foam;

(ii) a slot formed in said wall extending generally longitudinally and at an angle to said longitudinal axis of said C-shaped cross-section member; and (iii) a hinge recess also formed in said wall extending generally longitudinally, for reducing self-vibration noises and screeching noises between a cleaning blade and an imaging member of an electrostatographic reproduction machine.

15. The electrostatographic reproduction machine of claim 14, wherein said imaging member comprises a hollow drum.

16. The electrostatographic reproduction machine of claim 14, wherein said hinge recess extends generally longitudinally and at an angle to said longitudinal axis of said C-shaped cross-section member.

17. The electrostatographic reproduction machine of claim 14, wherein said slot and said hinge recess each extend generally longitudinally and at an angle to said longitudinal axis of said C-shaped cross-section member.

18. The electrostatographic reproduction machine of claim 14, wherein said C-shaped member comprises a non-metallic tube.

19. The electrostatographic reproduction machine of claim 14, wherein said C-shaped member is made of any suitable polymer.

20. The electrostatographic reproduction machine of claim 14, wherein said C-shaped member includes a wall having at least one recess extending axially thereof and having a depth that is less than a thickness of said wall.

* * * * *